US011384991B2

(12) United States Patent
Bando

(10) Patent No.: US 11,384,991 B2
(45) Date of Patent: Jul. 12, 2022

(54) HEAT EXCHANGER

(71) Applicant: Mitsubishi Electric Corporation, Tokyo (JP)

(72) Inventor: Yuhei Bando, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 31 days.

(21) Appl. No.: 17/051,226

(22) PCT Filed: Jun. 6, 2018

(86) PCT No.: PCT/JP2018/021701
§ 371 (c)(1),
(2) Date: Oct. 28, 2020

(87) PCT Pub. No.: WO2019/234847
PCT Pub. Date: Dec. 12, 2019

(65) Prior Publication Data
US 2021/0071960 A1 Mar. 11, 2021

(51) Int. Cl.

| | |
|---|---|
| ***F28D 7/02*** | (2006.01) |
| ***F28D 7/16*** | (2006.01) |
| ***F28F 1/02*** | (2006.01) |
| ***F28F 1/30*** | (2006.01) |
| ***F28F 9/02*** | (2006.01) |

(52) U.S. Cl.
CPC ..... *F28D 7/1684* (2013.01); *F28F 1/02* (2013.01); *F28F 1/30* (2013.01); *F28F 9/02* (2013.01)

(58) Field of Classification Search
CPC ... F28D 7/1684; F28F 1/02; F28F 1/30; F28F 9/02
USPC ..... 165/175
See application file for complete search history.

(56) References Cited

U.S. PATENT DOCUMENTS 5,174,366 A * 12/1992 Nagakura ..... F28F 1/325 165/77
7,500,515 B2 * 3/2009 Tsuji ..... B21D 39/06 165/173

FOREIGN PATENT DOCUMENTS

| | | | |
|---|---|---|---|
| JP | H04-344033 | A | 11/1992 |
| JP | H06-126544 | A | 5/1994 |
| JP | 2002-243381 | A | 8/2002 |
| JP | 2005_133966 | A | 5/2005 |
| JP | 5518104 | B2 | 4/2014 |

OTHER PUBLICATIONS

International Search Report of the International Searching Authority dated Aug. 14, 2018 for the corresponding International application No. PCT/JP2018/021701 (and English translation).

* cited by examiner

*Primary Examiner* — Davis D Hwu
(74) *Attorney, Agent, or Firm* — Posz Law Group, PLC

(57) ABSTRACT

A heat exchanger includes flat tubes spaced apart from each other and located in parallel, a header that connects end portions of the flat tubes, and a fin joined between the flat tubes adjacent to each other. The fin is provided with a break line that breaks the fin when bending is performed. A cut is provided at both ends of the break line on the fin including a first end and a second end, and extends parallel to the airflow direction from the first end to the second end.

5 Claims, 4 Drawing Sheets

HEAT EXCHANGER

CROSS REFERENCE TO RELATED APPLICATION

This application is a U.S. national stage application of PCT/JP2018/021701 filed on Jun. 6, 2018, the contents of which are incorporated herein by reference.

TECHNICAL FIELD

The present disclosure relates to a parallel-flow heat exchanger.

BACKGROUND ART

When a parallel-flow heat exchanger is stored in a limited space of a housing, the heat exchanger needs to be bent into an L-shape or other shape. When bending is performed on the heat exchanger, flat tubes located at a bent portion of the heat exchanger and fins closely joined to the flat tubes are deformed. This results in significant degradation in performance of the heat exchanger. In view of the above, a heat exchanger has been proposed conventionally in which ease of storage is improved and degradation in performance of the heat exchanger is minimized (for example, see Patent Literature 1).

Patent Literature 1 discloses a heat exchanger in which a plurality of heat exchangers are connected, each of which includes a pair of headers extending substantially horizontally with a predetermined space between the headers, a plurality of heat transfer tubes located between the pair of headers, a fin located between the heat transfer tubes adjacent to each other, an inlet tube for refrigerant connected to an end portion of one of the pair of headers, and an outlet tube for refrigerant connected to an end portion of the other of the pair of headers. A connection portion extends substantially horizontally at which the heat exchanger with the long header and the heat exchanger with the short header are connected by a connection pipe to be formed into an L-shape. The heat exchanger disclosed in Patent Literature 1 is configured as described above, so that ease of storage is improved and a reduction in heat exchange efficiency is minimized.

CITATION LIST

Patent Literature

Patent Literature 1: Japanese Patent Publication No, 5518104

SUMMARY OF INVENTION

Technical Problem

However, in Patent Literature 1, there is a problem in that since an L-shaped connection pipe is used to form the heat exchanger with an L-shape, this needs an extra machining step such as brazing. There is also a problem in that since a shield material that blocks airflow is affixed to a gap formed between upper and lower L-shaped connection pipes where the fins and the flat tubes are not present after the heat exchanger with an L-shape is formed, heat exchange efficiency is reduced due to presence of this section to which the shield material is affixed.

The present disclosure has been made in view of the above problems, and it is an object of the present disclosure to provide a heat exchanger that minimizes a reduction in heat exchange efficiency without increasing the number of extra machining steps when bending is performed.

Solution to Problem

A heat exchanger according to an embodiment of the present disclosure includes: a plurality of flat tubes spaced apart from each other and located in parallel; a header configured to connect end portions of the plurality of flat tubes; and a fin joined between the flat tubes adjacent to each other, wherein the fin is provided with a break line configured to break the fin when bending is performed.

Advantageous Effects of Invention

In a heat exchanger according to an embodiment of the present disclosure, when bending is performed on the heat exchanger, a stress acts on a fin and thus causes the fin to be broken along a break line; and accordingly deformation of flat tubes is minimized. With this configuration, the heat exchanger can minimize a reduction in heat exchange efficiency without increasing the number of extra machining steps.

DESCRIPTION OF EMBODIMENTS

Figure 1:
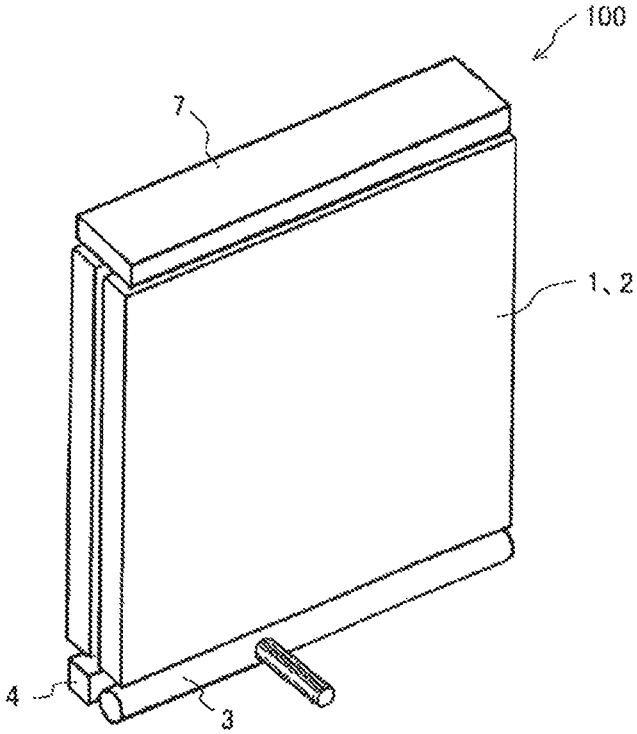
FIG. 1 is a schematic perspective view illustrating a heat exchanger according to Embodiment 1 of the present disclosure.

Embodiments of the present disclosure will be described hereinafter with reference to the drawings. Note that the present disclosure is not limited by the embodiments described below. In addition, the relationship of sizes of the components in the drawings described below may differ from that of actual ones.

Embodiment 1

Figure 2:
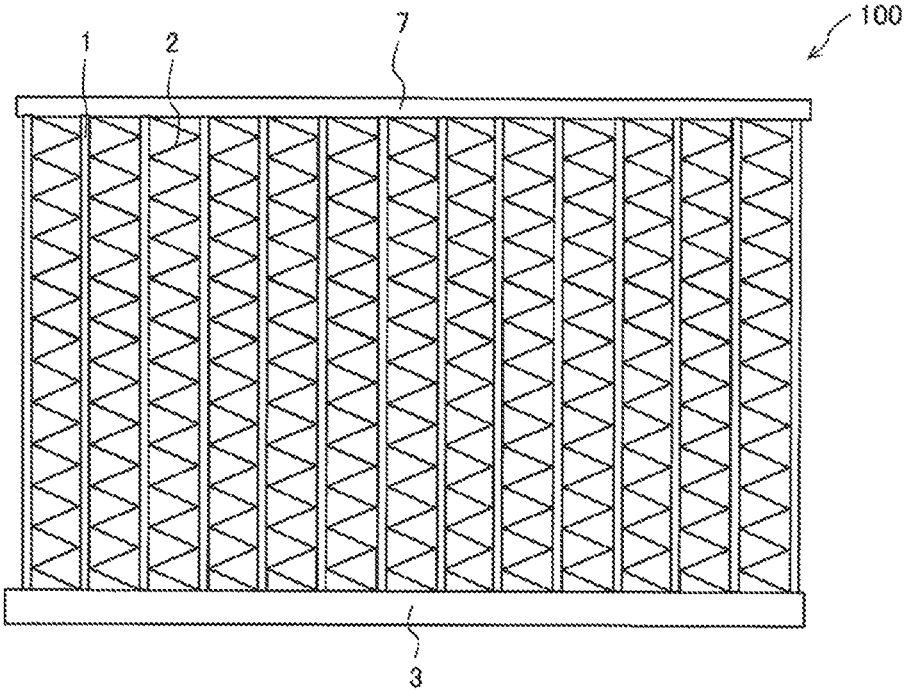
FIG. 2 is a schematic side view illustrating the heat exchanger according to Embodiment 1 of the present disclosure.
Figure 3:
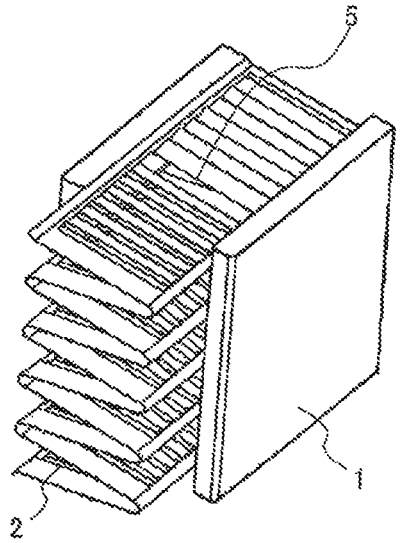
FIG. 3 is an enlarged view of a flat tube and a fin of the heat exchanger according to Embodiment 1 of the present disclosure.

FIG. 1 is a schematic perspective view illustrating a heat exchanger 100 according to Embodiment 1 of the present disclosure. FIG. 2 is a schematic side view illustrating the heat exchanger 100 according to Embodiment 1 of the present disclosure. FIG. 3 is an enlarged view of a flat tube 1 and a fin 2 of the heat exchanger 100 according to Embodiment 1 of the present disclosure.

The heat exchanger 100 according to Embodiment 1 is a parallel-flow heat exchanger. For example, the heat exchanger 100 is installed in an indoor unit or an outdoor unit of an air-conditioning apparatus, and exchanges heat between air passing through the heat exchanger 100 and refrigerant flowing through the flat tube 1. As illustrated in FIGS. 1 and 2, the heat exchanger 100 includes the flat tube 1, the fin 2, a liquid header 3, a gas header 4, and a row-crossing header 7.

As illustrated in FIG. 2, a plurality of the flat tubes 1 are oriented in the vertical direction (the direction of gravity), and are located in two rows in parallel and spaced apart from each other in the horizontal direction. Between the flat tubes 1 adjacent to each other, the fin 2 that is, for example, made of aluminum and machined into a corrugated shape (for example, a corrugated fin) is brazed. As illustrated in FIG. 3, the fin 2 is formed with a cutout 5 in consideration of drainage and other factors.

As illustrated in FIGS. 1 and 2, the liquid header 3 is oriented in the horizontal direction, and is formed with a plurality of holes on the longitudinal side thereof at approximately equal intervals. Lower end portions of the flat tubes 1 in one of the two rows of the holes are connected into these holes, respectively. A liquid inlet/outlet (not illustrated) is provided on one side of the liquid header 3, through which liquid refrigerant flows in during cooling operation and liquid refrigerant flows out during heating operation. The other side of the liquid header 3 is closed. The gas header 4 is oriented in the horizontal direction and is located facing the liquid header 3. The gas header 4 is formed with a plurality of holes on the longitudinal side thereof at approximately equal intervals. Lower end portions of the flat tubes 1 in the other of the two rows of the holes are connected into these holes. A gas inlet/outlet (not illustrated) is provided on one side of the gas header 4, through which gas refrigerant flows out during cooling operation and gas refrigerant flows in during heating operation. The other side of the gas header 4 is closed.

The row-crossing header 7 is oriented in the horizontal direction, and is formed with two rows of holes on the longitudinal side thereof at approximately equal intervals. Upper end portions of the flat tubes 1, whose lower end portions are connected to the liquid header 3, are connected into the holes in one of the two rows of the holes on the row-crossing header 7. Upper end portions of the flat tubes 1, whose lower end portions are connected to the gas header 4, are connected into the holes in the other of the two rows of the holes on the row-crossing header 7.

Next, a flow of refrigerant in the heat exchanger 100 according to Embodiment 1 is described.

During cooling operation, liquid refrigerant flowing into the liquid header 3 from the liquid inlet/outlet is supplied to the flat tubes 1 in one of the two rows of the flat tubes, and exchanges heat via the fins 2 with air passing through the fins 2 to receive heat from the air. Thereafter, the liquid refrigerant flowing out from the flat tubes 1 in one of the two rows of the flat tubes passes through the row-crossing header 7 and is supplied to the flat tubes 1 in the other of the two rows of the flat tubes. The liquid refrigerant exchanges heat via the fins 2 with air passing through the fins 2, receives heat from the air, and changes to gas refrigerant. Thereafter, the gas refrigerant flows to the gas header 4.

In contrast, during heating operation, gas refrigerant flowing into the gas header 4 from the gas inlet/outlet is supplied to the flat tubes 1 in one of the two rows of the flat tubes, and exchanges heat via the fins 2 with air passing through the fins 2 to transfer heat to the air. Thereafter, the gas refrigerant flowing out from the flat tubes 1 in one of the two rows of the flat tubes passes through the row-crossing header 7 and is supplied to the flat tubes 1 in the other of the two rows of the flat tubes. The gas refrigerant exchanges heat via the fins 2 with air passing through the fins 2, transfers heat to the air, and changes to liquid refrigerant. Thereafter, the liquid refrigerant flows to the liquid header 3.

Figure 4:
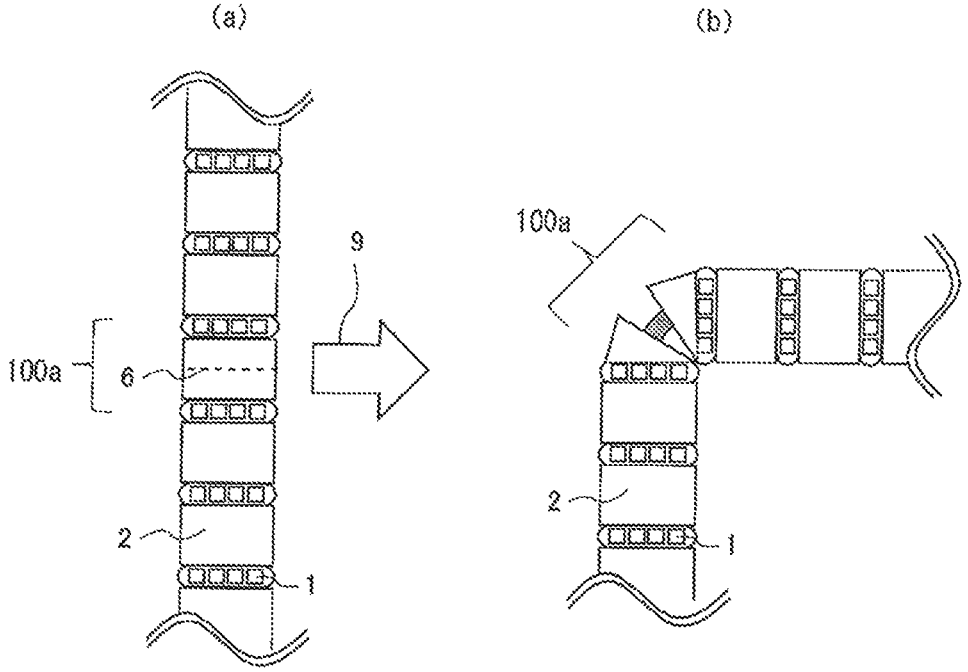
FIG. 4 are explanatory views illustrating bending performed on the heat exchanger according to Embodiment 1 of the present disclosure.

FIG. 4 are explanatory views illustrating bending performed on the heat exchanger 100 according to Embodiment 1 of the present disclosure.

Figure 5:
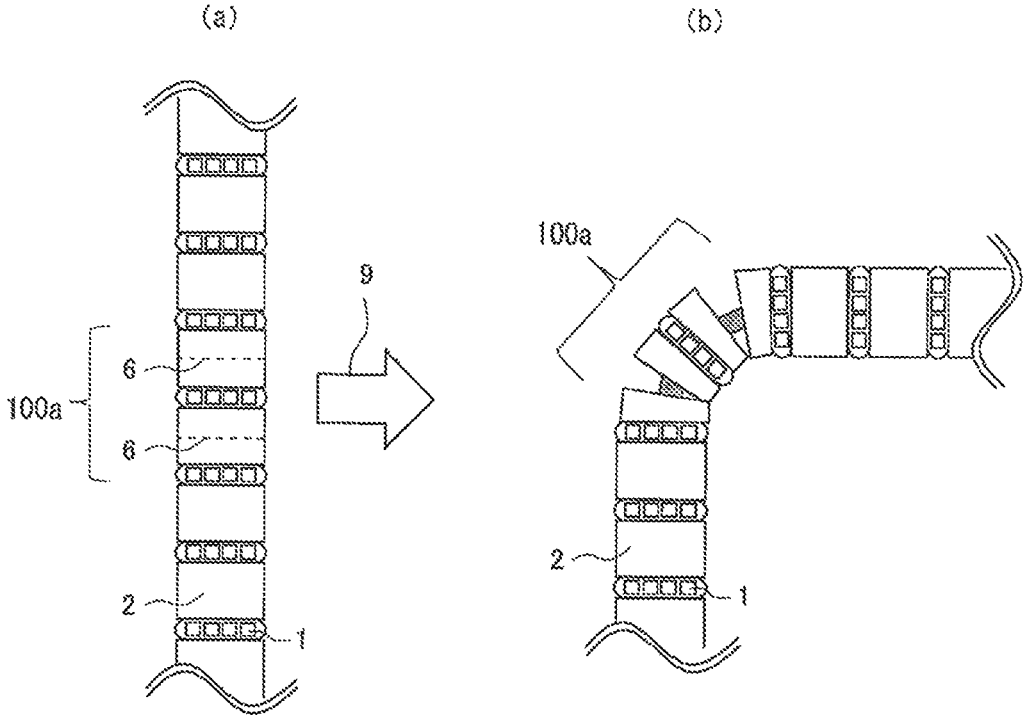
FIG. 5 are explanatory views illustrating a modification of the bending performed on the heat exchanger according to Embodiment 1 of the present disclosure.

FIG. 5 are explanatory views illustrating a modification of the bending performed on the heat exchanger 100 according to Embodiment 1 of the present disclosure. Note that FIGS. 4(*a*) and 5(*a*) illustrate the flat tubes 1 and the fins 2 before the heat exchanger 100 undergoes bending, while FIGS. 4(*b*) and 5(*b*) illustrate the flat tubes 1 and the fins 2 after the heat exchanger 100 undergoes bending.

As illustrated in FIG. 4(*a*), a part of the fin 2 is provided with a break line 6 extending along an airflow direction 9 that is a direction perpendicular to the heat exchanger 100. A plurality of the break lines 6 are provided. Each of the break lines 6 is provided at the same position on the fin 2 in the longitudinal direction of the flat tubes 1. Note that each of the break lines 6 is provided by, for example, forming a plurality of holes on a part of the fin 2 along the airflow direction with a tool.

Conventionally, when a heat exchanger undergoes bending, a stress acts on flat tubes and fins and thus may cause the flat tubes to be deformed. In contrast, in Embodiment 1, as illustrated in FIG. 4(*b*), when the heat exchanger 100 undergoes bending, a stress acts on the fin 2 and thus causes the fin 2 to be broken along the break line 6. That is, the heat exchanger 100 is divided by the break line 6 into two parts in the vertical direction. This configuration can minimize the stress acting on the flat tubes 1, and can accordingly minimize deformation of the flat tubes 1. Even after the heat exchanger 100 undergoes bending, the fin 2 still remains in a bent portion 100*a*. This eliminates the need for a shield material and can maintain the heat exchange efficiency. The bent portion 100*a* refers to a portion of the heat exchanger 100 to be bent when the heat exchanger 100 undergoes bending.

Note that in Embodiment 1, the break line 6 is provided at a single location in plan view of the fins 2 as illustrated in FIG. 4(*a*). However, location of the break line 6 is not limited thereto, and the break lines 6 may be provided at two locations in plan view of the fins 2 as illustrated in FIG. 5(*a*) or may be provided at three or more locations.

As described above, the break line 6 is provided on a part of the fin 2, so that the heat exchanger 100 can easily undergo bending. When the heat exchanger 100 undergoes bending, a stress acts on the fin 2 and thus causes the fin 2 to be broken along the break line 6. This configuration can minimize the stress acting on the flat tubes 1, and can accordingly minimize deformation of the flat tubes 1. When the heat exchanger 100 is formed into an L-shape, an L-shaped connection pipe is not needed. Thus, an extra machining step such as brazing is not needed, so that the machining steps can be shortened. Even after the heat exchanger 100 undergoes bending, the fin 2 still remains in the bent portion 100*a*. This eliminates the need for a shield material and can maintain the heat exchange efficiency.

Note that the break line 6 is provided at the position of the center of the bent portion 100*a* of the heat exchanger 100. Thus, after the fin 2 is broken into two parts, these two parts have an equal area where the fin 2 is joined to the flat tube 1. This reduces variations in the amount of heat exchange in the fin 2 and accordingly can improve the heat exchange efficiency. The break line 6 may not be exactly at the position of the center of the bent portion 100*a* of the heat exchanger 100.

The heat exchanger 100 according to Embodiment 1 is a parallel-flow heat exchanger, in which the liquid header 3 or the gas header 4 is connected to the lower end portions of the flat tubes 1, and the row-crossing header 7 is connected to the upper end portions of the flat tubes 1. However, the configuration of the heat exchanger 100 is not limited thereto. For example, the heat exchanger 100 may be a parallel-flow heat exchanger, in which a liquid header is connected to the lower end portions of the flat tubes 1, and a gas header is connected to the upper end portions of the flat tubes 1.

Embodiment 2

Embodiment 2 of the present disclosure will be hereinafter described. Mere of overlapping of descriptions between Embodiment 1 and Embodiment 2 are omitted, and the parts that are the same as or equivalent to those described in Embodiment 1 are denoted by the same reference sings.

Figure 6:
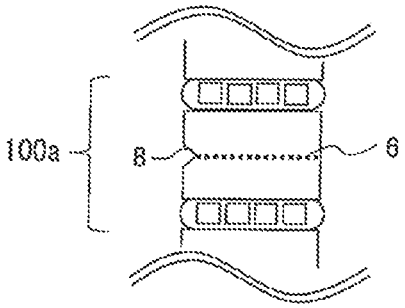
FIG. 6 is a schematic plan view illustrating a bent portion of the heat exchanger according to Embodiment 2 of the present disclosure.
Figure 7:
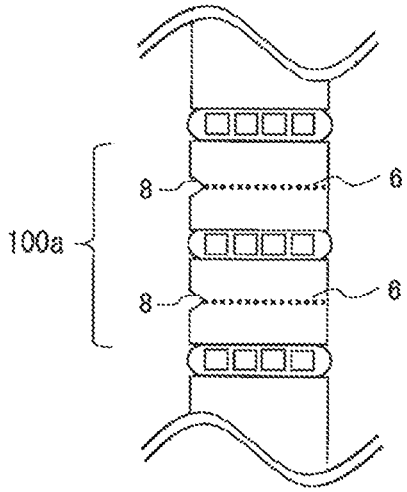
FIG. 7 is a schematic plan view illustrating a modification of the bent portion of the heat exchanger according to Embodiment 2 of the present disclosure.

FIG. 6 is a schematic plan view illustrating the bent portion 100*a* of the heat exchanger 100 according to Embodiment 2 of the present disclosure. FIG. 7 is a schematic plan view illustrating a modification of the bent portion 100*a* of the heat exchanger 100 according to Embodiment 2 of the present disclosure.

As illustrated in FIG. 6, in Embodiment 2, a cut 8 with a V-shape is provided at one end of the break line 6 on the fin 2. Since the fin 2 is provided with the cut 8 in the manner as described above, it is easy for the fin 2 to be broken along the break line 6 when bending is performed.

Note that in Embodiment 2, the cut 8 with a V-shape is provided at one end of the break line 6 on the fin 2; however, the configuration of the cut 8 is not limited thereto and the cut 8 with a V-shape may be provided at the opposite ends of the break line 6 on the fin 2. While the cut 8 has a V-shape, the shape of the cut 8 is not limited thereto. The cut 8 may have any other shape as long as the shape achieves the effect of easily breaking the fin 2 along the break line 6 when bending is performed.

As illustrated in FIG. 7, in a case where the break lines 6 are provided at two locations in plan view of the fins 2, it is preferable that the cut 8 with a V-shape is provided at one end of each of the break lines 6.

REFERENCE SIGNS LIST

1 flat tube 2 fin 3 liquid header 4 gas header 5 cutout 6 break line 7 row-crossing header 8 cut 9 airflow direction 100 heat exchanger 100*a* bent portion

The invention claimed is:

1. A heat exchanger comprising:

a plurality of flat tubes spaced apart from each other and located in parallel, the flat tubes being disposed to be oriented along an airflow direction;

a header configured to connect end portions of the plurality of flat tubes; and a fin joined between the flat tubes adjacent to each other, wherein the fin is provided with a break line, configured to break the fin when bending is performed, and a cut is provided at both ends of the break line on the fin including a first end and a second end, and the break line extends parallel to the airflow direction from the first end to the second end.

2. The heat exchanger of claim 1, wherein a plurality of the fins are provided, at least two of the fins each having a respective break line at the position of a center between adjacent flat tubes in a plan view of the heat exchanger, and on the at least two fins, the break lines are provided at a respective same position in a longitudinal direction of the flat tubes.

3. The heat exchanger of claim 1, wherein the break line is provided at a position of a center of a bent portion that is a portion of the heat exchanger to be bent when bending is performed.

4. The heat exchanger of claim 1, wherein the break line is constituted by a plurality of holes formed on the fin.

5. The heat exchanger of claim 1, wherein the break line extends along an airflow direction, a plurality of the break lines are provided on the fin, and the break lines are arranged at a same position on the fin along a longitudinal direction of the flat tubes, the longitudinal direction being located in parallel to the flat tubes.

* * * * *